US008754770B2

(12) United States Patent
Libby

(10) Patent No.: US 8,754,770 B2
(45) Date of Patent: Jun. 17, 2014

(54) SYSTEM AND METHOD FOR BEYOND PERIMETER DETECTION AND EARLY WARNING

(71) Applicant: Lockheed Martin Corporation, Bethesda, MD (US)

(72) Inventor: Vibeke Libby, Woodside, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 72 days.

(21) Appl. No.: 13/666,903

(22) Filed: Nov. 1, 2012

(65) Prior Publication Data

US 2013/0113625 A1 May 9, 2013

Related U.S. Application Data

(60) Provisional application No. 61/557,359, filed on Nov. 8, 2011.

(51) Int. Cl.
*G08B 13/00* (2006.01)

(52) U.S. Cl.
USPC ..... 340/541

(58) Field of Classification Search
USPC ..... 340/541, 506, 539.21, 565, 539.23, 340/540; 250/342, 349, 353
See application file for complete search history.

(56) References Cited

U.S. PATENT DOCUMENTS

| | | | | |
|---|---|---|---|---|
| 4,841,284 | A * | 6/1989 | Biersdorff | 340/567 |
| 4,897,630 | A * | 1/1990 | Nykerk | 340/426.25 |
| 5,393,978 | A * | 2/1995 | Schwarz | 250/353 |
| 6,317,040 | B1 * | 11/2001 | Ikeda | 340/522 |
| 7,154,391 | B2 * | 12/2006 | Maki et al. | 340/550 |
| 8,441,350 | B2 * | 5/2013 | Candelore | 340/565 |
| 2007/0252720 | A1 * | 11/2007 | Hughes et al. | 340/691.3 |
| 2008/0238671 | A1 * | 10/2008 | Woosnam | 340/566 |

* cited by examiner

*Primary Examiner* — Phung Nguyen
(74) *Attorney, Agent, or Firm* — McDermott Will & Emery LLP

(57) ABSTRACT

A system for beyond perimeter detection and early warning may comprise multiple sensors positioned in a first field, a number of reflectors positioned in a second field outside a first perimeter defined by the first field, and one or more transceivers. Each transceiver may comprise a transmitter to transmit radio frequency (RF) signals, a first and a second receiver to receive signals from some of a set of the of the multiple sensors and reflected signals from some/all of the reflectors in response to the transmitted RF signals. The transceiver may also include a monitor module to detect a perturbed signal resulting from the received sensor signals and reflected signals, and an alarm module to generate an early warning alarm signal based on the detection of the perturbed signal to indicate that an intruder has crossed a second perimeter defined by the second field.

20 Claims, 6 Drawing Sheets

SYSTEM AND METHOD FOR BEYOND PERIMETER DETECTION AND EARLY WARNING

CROSS-REFERENCE TO RELATED APPLICATIONS

This application claims the benefit of priority under 35 U.S.C. §119 from U.S. Provisional Patent Application 61/557,359 filed Nov. 8, 2011, which is incorporated herein by reference in its entirety.

STATEMENT REGARDING FEDERALLY SPONSORED RESEARCH OR DEVELOPMENT

Not applicable.

FIELD OF THE INVENTION

The present invention generally relates to security systems, and more particularly to a system and method for beyond perimeter detection and early warning.

BACKGROUND

Securing a large area or perimeter can be very costly. A typical solution is to install a fence or a camera system along the perimeter of the secured area. However, these systems (e.g., camera system) typically require power, have a small field-of-view, and are generally vulnerable to breaking down or sabotage. Alternatively, an aerial reconnaissance of the secured area can be provided-using drones, airplanes or satellites. The problem with such solutions are the cost. As the size of a protected site increases, the cost of perimeter protection increases. And often, a perimeter is bordering a road or access road which is beyond an installed fence or other barrier. Therefore, traffic patterns and people near the fence will most often go unnoticed when using traditional fence protection technologies. In these situations, potential intruders stalking the facility will not be detected and an early warning for such act ivies will go unnoticed. A cost effective solution to this or the like scenarios is highly desirable.

SUMMARY

In some aspects, a system for beyond perimeter detection and early warning may comprise multiple sensors positioned in a first field, a number of reflectors positioned in a second field outside a first perimeter defined by the first field, and one or more transceivers. The transceiver may comprise a transmitter, a first and a second receiver (not necessarily co-located), a monitor module, a detection module and an alarm module. The transmitter may be configured to transmit radio frequency (RF) signals. The first receiver may be configured to receive sensor signals from some/all of the multiple sensors in response to the transmitted RF signals. The second receiver may be configured to receive reflected signals from some/all of the plurality reflectors in response to the transmitted RF signals. The monitor module may be configured to detect a perturbed signal resulting from the received sensor signals and reflected signals. The alarm module may be configured to generate an alarm signal based on the detection of the perturbed signal. The alarm signal may be an early warning alarm signal indicating that an intruder has crossed a second perimeter defined by the second field. In an aspect, the system may be fully functional with a single receiver that may replace and perform the functions of the first and the second receivers.

In another aspect, a method for beyond perimeter detection and early warning may comprise transmitting, from a transceiver, radio frequency (RF) signals, and receiving, at the transceiver, sensor signals from some/all of the sensors positioned in a first field and reflected signals from some/all of the reflectors positioned in a second field outside a first perimeter defined by the first field, in response to the transmitted RF signals. A perturbed signal resulting from the received sensor signals and reflected signals may be detected by a monitor module. An alarm signal may be generated based on the detection of the perturbed signal. Each sensor may be identified by a unique identifier. The alarm signal may be an early warning alarm signal indicating that an intruder has crossed a second perimeter defined by the second field. The detection of the perturbed signal may be performed by making a comparison with a reference signal In yet another aspect, a system for beyond perimeter detection and early warning may comprise a transmitter, a first and a second receiver, a monitor module, and an alarm module. The transmitter may be configured to transmit radio frequency (RF) signals. The first and second receivers may be configured to receive sensor signals from some/all of the sensors positioned in a first field and reflected signals from some/all of the reflectors positioned in a second field, in response to the transmitted RF signals. The monitor module may be configured to detect a perturbed signal resulting from the received sensor signals and reflected signals. The alarm module may be configured to generate an alarm signal based on the detection of the perturbed signal. The second field may be located outside of a first perimeter defined by the first field. The alarm signal may be an early warning alarm signal indicating that an intruder has crossed a second perimeter defined by the second field. The detection of the perturbed signal may be performed by making a comparison with a reference signal.

The foregoing has outlined rather broadly the features of the present disclosure in order that the detailed description that follows can be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

The present disclosure is directed, in part, to a system for beyond perimeter detection and early warning (e.g., a security and early warning system). The system may comprise multiple sensors positioned in a first field (e.g., sensor field), a number of reflectors positioned in a second field (e.g., reflector field) outside a first perimeter defined by the first field, and one or more transceivers. The transceiver (e.g., a transmitter-receiver (Tx/Rx)) may comprise a transmitter, a first and a second receiver, a monitor module, a detection module and an alarm module. The transmitter may transmit radio frequency (RF) signals that can reach beyond the sensor field. The first receiver may be configured to receive sensor signals from some/all of the sensors in the sensor field, in response to the transmitted RF signals. The second receiver may be configured to receive reflected signals from some/all of the plurality reflectors in the reflector field, in response to the transmitted RF signals. The monitor module may be configured to detect a perturbed signal resulting from the received sensor signals and reflected signals. The perturbed signal may be caused by an intruder entering the reflector field. The alarm module may be configured to generate an early warning alarm signal based on the detection of the perturbed signal. The detection of the perturbed signal may be performed by making a comparison with a reference signal, which may be generated based on a measured strength of the received sensor signals and the received reflected signals in an unperturbed condition. The unperturbed condition may be defined with respect to an intrusion of an intended intruder, and wherein the measured strength of a signal may include a measured power of the signal.

In an aspect, a security and early warning system may include a number of RF sensors and/or RF mirrors. The RF sensors and mirrors may be disguised as road-reflectors or the like. Each of the reflectors may consist of small RF reflecting surfaces, for example an ordinary mirror positioned in the reflector field, outside a protected area. In one aspect, the RF mirrors and sensors may not require any power source. The RF sensors may attain their operating powers from the received interrogation signals. The system may also include an antenna configured to facilitate transmission of interrogation signals to the mirrors and sensors. When the RF interrogation and power-providing signal hits the sensor field and mirrors field, the return or response signal may become a jumble of repeatable multipath signals. In one embodiment, the jumble of multi path signals may repeatable and stable under undisturbed circumstances.

Figure 1B:
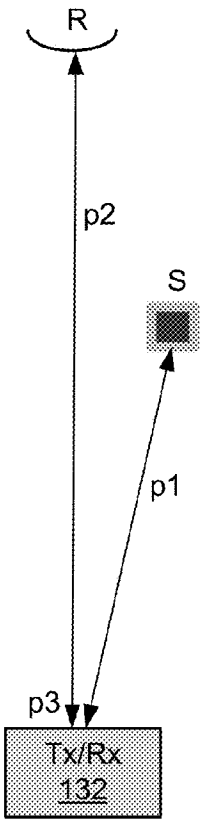
FIG. 1B is a diagram illustrating an exemplary power signal formation from an example system comprising a single sensor and a single reflector, according to certain embodiments.
Figure 1A:
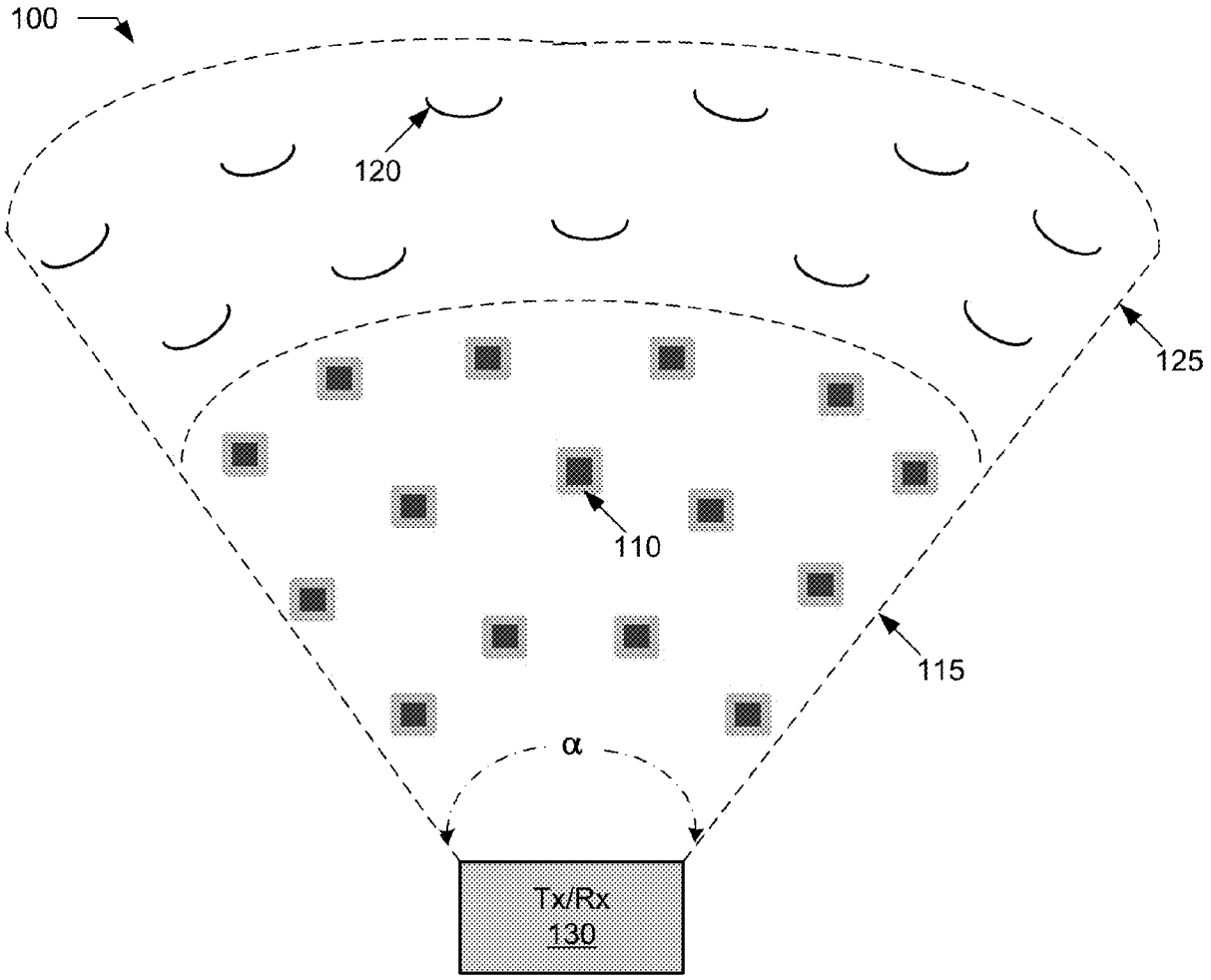
FIG. 1A is a diagram illustrating an example system for beyond perimeter detection and early warning, according to certain embodiments.

FIG. 1A is a diagram illustrating an example system 100 for beyond perimeter detection and early warning, according to certain embodiments. The security and early warning system 100A may comprise a transceiver (e.g., Tx/Rx) 130, a number of sensors (e.g., RF sensors) 110 positioned in a first field (e.g., a sensor field) 115 and a number of reflectors (e.g., RF reflectors) 120 positioned in a second field (e.g., a reflector field) 125. The transceiver 130 may include an antenna that can propagate RF signals as electromagnetic waves. The antenna may have a propagation pattern covering an angular window of $\alpha$ degrees (e.g., 60 degrees). The transmission power of the transmitter of the transceiver 130 may be sufficient to reach beyond the perimeter of the sensor field 115 an propagate throughout the reflector field 125.

In an aspect, the sensor field 115 may be beyond a primary boundary (e.g., a fenced boundary) of a subject area, which is to be secured. The reflector field 125 further extends the secured area at low cost, and provides early warning of an intruder. For example, if a first perimeter defined by the sensor field 115 is at 100 m distance from the transceiver, the reflector field may extend to a 500 m distance, therefore adding a substantially large secured area at a significantly lower cost, as compared to a larger sensor field or a physical secondary wall (e.g., a fence). Any intruder approaching the sensor field from any point in the reflector field may cause the system to generate an early warning alarm, which can provide additional time for action, especially, when the intruder is approaching in a fast speed, for example, by a using motor vehicle (e.g., a car, a tuck, etc.).

In some aspects, each sensor 110 may be interrogated by the transceiver 130 using a different frequency. For example, if there are N (e.g., 50) sensors in the sensor field 115, N different frequencies may be used by the transceiver 130 to ping the N sensors. Each sensor may be pinged at specific time interval and the entire sensors of the sensor field 115 may be pinged in a short time period (e.g., 1 second). Each sensor may respond with a signal at the same frequency that it is pinged with. In some aspects, the sensor may respond with a different but distinguished frequency. In an aspect, each sensor may be identified by a unique identifier (e.g., a bar code, such as an RF bar code) which may be associated with the location information of the sensor within the sensor field 115. In one aspect, the particular frequency that a sensor responds with may be used as the identifier for that sensor.

In some aspects, the reflectors 120 may not be positioned in known locations, but there can be as many of the reflectors 120 as the security requires, and located at optional positions. Each reflector 120 may comprise a mirror or can be made of or contain an RF reflecting material (e.g., a conductor material, such as metal). Many structures (e.g., metallic towers) and buildings may also serve as reflectors. In some aspects, the reflected signals received by the transceiver from reflectors 120 may not contain any information related to the position of reflectors.

FIG. 1B is a diagram illustrating an exemplary power signal p3 formation from an example system 100B comprising a single sensor (S) and a single reflector (R), according to certain embodiments. The example single-sensor and single-reflector system shown in FIG. 1B is to show that the detected power component (p3) of a received signal at transceiver 132 is a summation of the power (p1) of the signal received from the Sensor S and the power (p2) of a reflected signal received from the reflector R. When multiple sensor and reflectors exists in the sensor field and reflector field the received signal at the transceiver 132 comprises a jumble of repeatable multipath signals, which may be a characteristic of the area or environment including the sensors and reflector fields.

Figure 2:
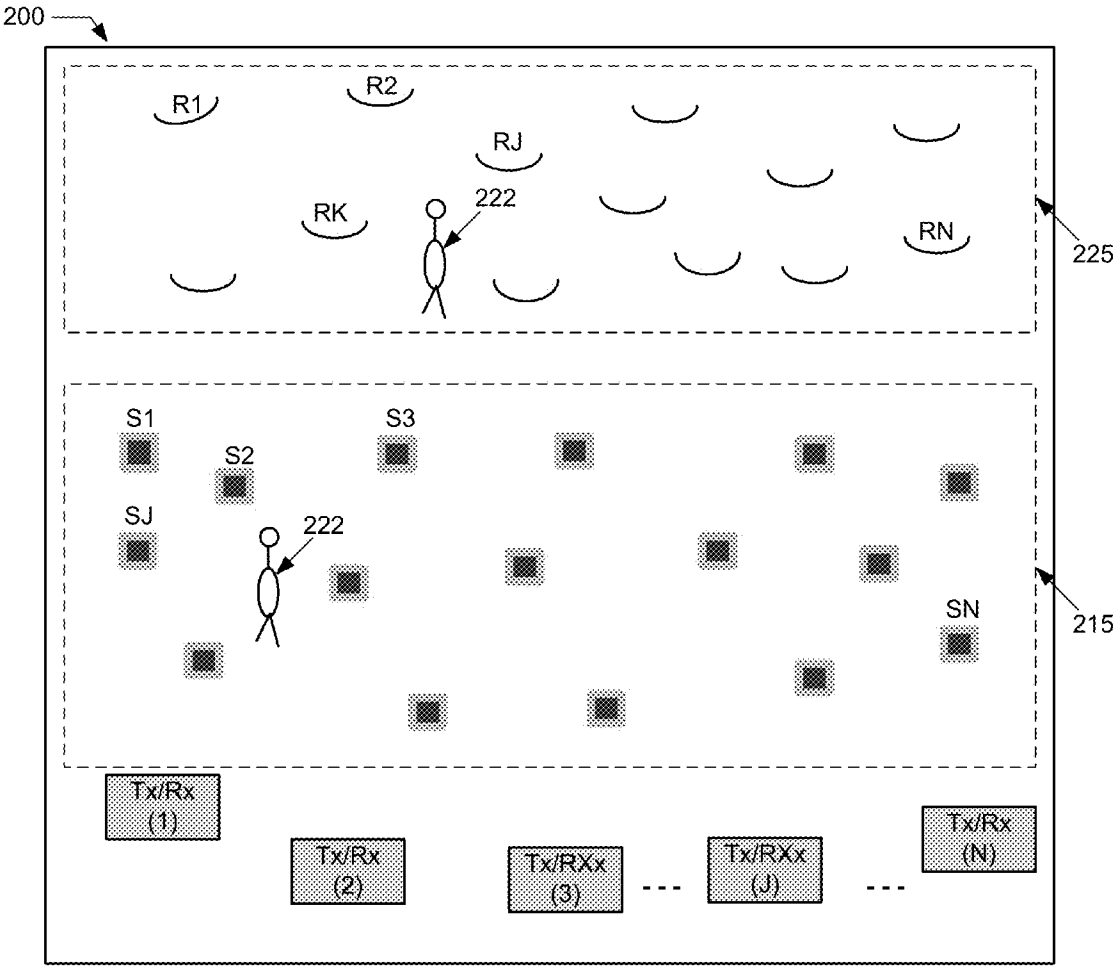
FIG. 2 is a diagram illustrating an example system for beyond perimeter detection and early warning including multiple transceivers, according to certain embodiments.

FIG. 2 is a diagram illustrating an example system 200 for beyond perimeter detection and early warning including multiple transceivers, according to certain embodiments. As indicated in FIG. 1A, a single transceiver may service a limited angular window (e.g., 60 degrees). For larger area overages, one may need to use a number (e.g., N, such as 5) of transceivers (e.g., Tx/Rx (1) to Tx/Rx (N)), preferably, with overlapping angular windows to provide coverage (e.g., transmit signals to and receive signals from) the entire sensors (S1-SN) of a sensor field 215 and the entire reflectors (R1-RN) of a reflector fields 225.

In an undisturbed condition, the multipath signal strength (e.g., the power component of the signal) at each transceiver is calibrated at a steady level (e.g., reference signal), which is a characteristic of the environment (e.g., natural, such as trees, sheds, buildings, road fences, power lines, etc., and other objects and structures in the environment) covered by that transceiver. An intended intruder 222 (e.g., a human being, an animal, a robot, a motor vehicle, etc., hereinafter "intruder,") in the reflector field 225 may for example, interfere with reflected signals from reflectors R2 as received by the transceivers (2) and (3), and reflected signals from reflector Rj as received by the transceivers (1) and (2). Therefore, the steady level of signals in at least transceivers (1) and (2) and (3) may be disrupted, resulting in an early warning alarm indicating that the intruder 222 is within the reflector field 225. Such an early warning alarm, provides the system for a first action, which may have been designed by the security administrators of the system. For example, the first action may include turning on a number of lights by the security guard station, directing a camera towards the intrusion point, or taking other actions that may scare off the intruder.

In one aspect, if the intruder 222, however, enters the sensor field 215, the received signals from some of sensors (S1-SN) at a number of transceivers (1) to (N) may be disrupted. For example, at the position shown in FIG. 2 of the intruder 222 in the sensor field 215, the sensor signals from sensors S1 and S2 at transceivers (2) and (3), the sensor signals from sensors S3 at transceivers (1), and the sensor signals from sensors Sj at transceivers (3) and possibly transceiver (j) may be disrupted. Given that the signals received from each sensor at each transceiver uniquely identifies the position of the respective sensor, an approximate position of the intruder 222 at any moment of time can be estimated.

Figure 3:
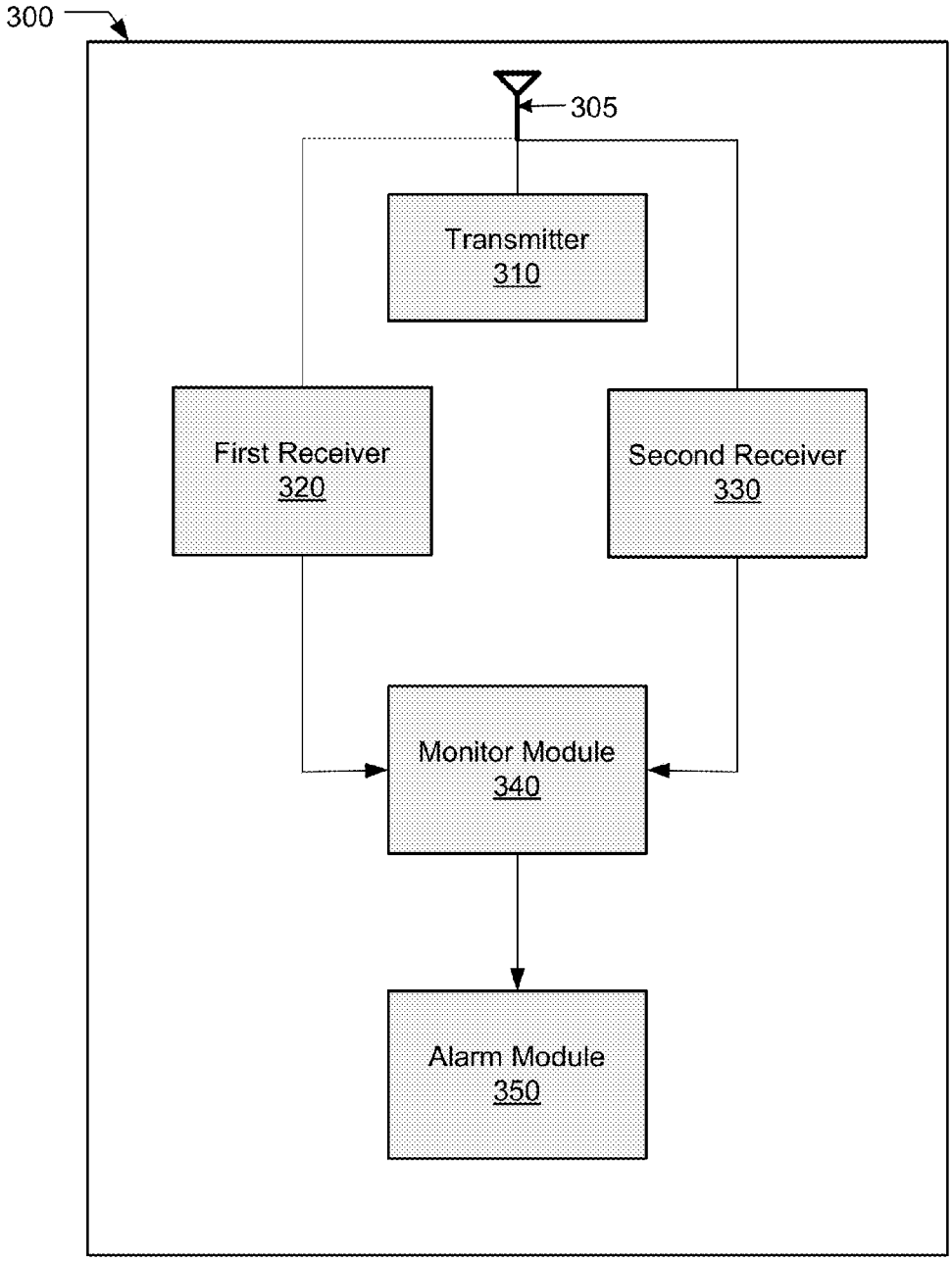
FIG. 3 is a diagram illustrating an exemplary transceiver of the system of FIGS. 1A and 2, according to certain embodiments.

FIG. 3 is a diagram illustrating an exemplary transceiver 300, according to certain embodiments. In an aspect, the transceiver 300 may represent the transceivers 130 of FIGS. 1A and 2. The transceiver 300 may include an antenna 305, a transmitter 310, a first receiver 320, a second receiver 330, a monitor module 340 and an alarm module 340. The antenna 305 may be configured to propagate RF signals generated by the transmitter 310 and receive sensor signals and reflected signals from some/all of the sensors and reflectors in the sensor field (e.g., 115 of FIG. 1A) and reflector field (e.g., 125 of FIG. 1A) and couple them to the first receiver 320 and the second receiver 330, respectively. In an aspect, the first and the second receivers may be combined into a single receiver coupled to the antenna 305. The transmission power of the transmitter 310 may be set to sufficient levels such that the propagated signals by the antenna 305 can reach the farthest reflector in the reflector field. The transmitter 310 may interrogate each sensor with a specific frequency. The specific frequency may be considered as the identifier for the respective sensor. Each sensor identifier may be associated with a position information of the respective sensor. The transmitter 310 may interrogate all sensor by pinging each sensor at a short time interval, so that the entirety of sensors in the field may be interrogated in a time period of the order of a second.

The first receiver 320 may be configured to receive sensor signals from some/all of the sensors in the sensor field. The first receiver 320 may couple the received sensor signal to the monitor module 340. The second receiver 320 may be configured to receive reflector signals from some/all of the reflectors in the reflector field. The receiver 330 may couple the received reflected signal to the monitor module 340. In an aspect, the functions of the first and the second receivers 320 and 330 may be performed by a single receiver (e.g., a two channel receiver).

The monitor module 340 may be configured to detect a perturbed signal resulting from the received sensor signals and the reflected signals. The detection of the perturbed signal may be performed by making a comparison with a reference signal. The monitor module 340 may generate the reference signal based on measured strengths of the received sensor signals and the received reflected signals in an unperturbed condition. The unperturbed condition may be defined with respect to an intrusion of an intended intruder (e.g., a human being, an animal, a robot, or a motor vehicle, etc.) and measured when in an unperturbed situation. In an aspect, the measured strength of a signal may include a measured power of that signal and the monitor module 240 may be calibrated to respond only to the intended intruders. Each of the perturbed signal and the reference signal may be a jumble of repeatable multipath signals and the monitor module 340 may be calibrated to generate a stable reference signal which can be a characteristic of non-intruded first and second fields (e.g., in the absence of an intended intruder).

The alarm module 350 may be configured to generate an alarm signal based on the detection of the perturbed signal. In an aspect, the alarm signal may be an early warning alarm signal indicating that an intruder has crossed the second perimeter defined by the second field (e.g., the reflector field 125 of FIG. 1A). The early warning alarm can provide sufficient time for action, especially, when the intruder is approaching in a fast speed, for example, by using a motor vehicle (e.g., a car, a tuck, etc.). In some aspects, other alarms may generated if the intended intruder succeeds in entering the sensor field (e.g., sensors filed 115 of FIG. 1A), as will be discussed herein. In the sensor field, the intruder may disrupt signals from a number of sensors. An approximate position of the intruder may be estimated based on identification of the sensors, signals from which are disrupted by the intruder.

Figure 4:
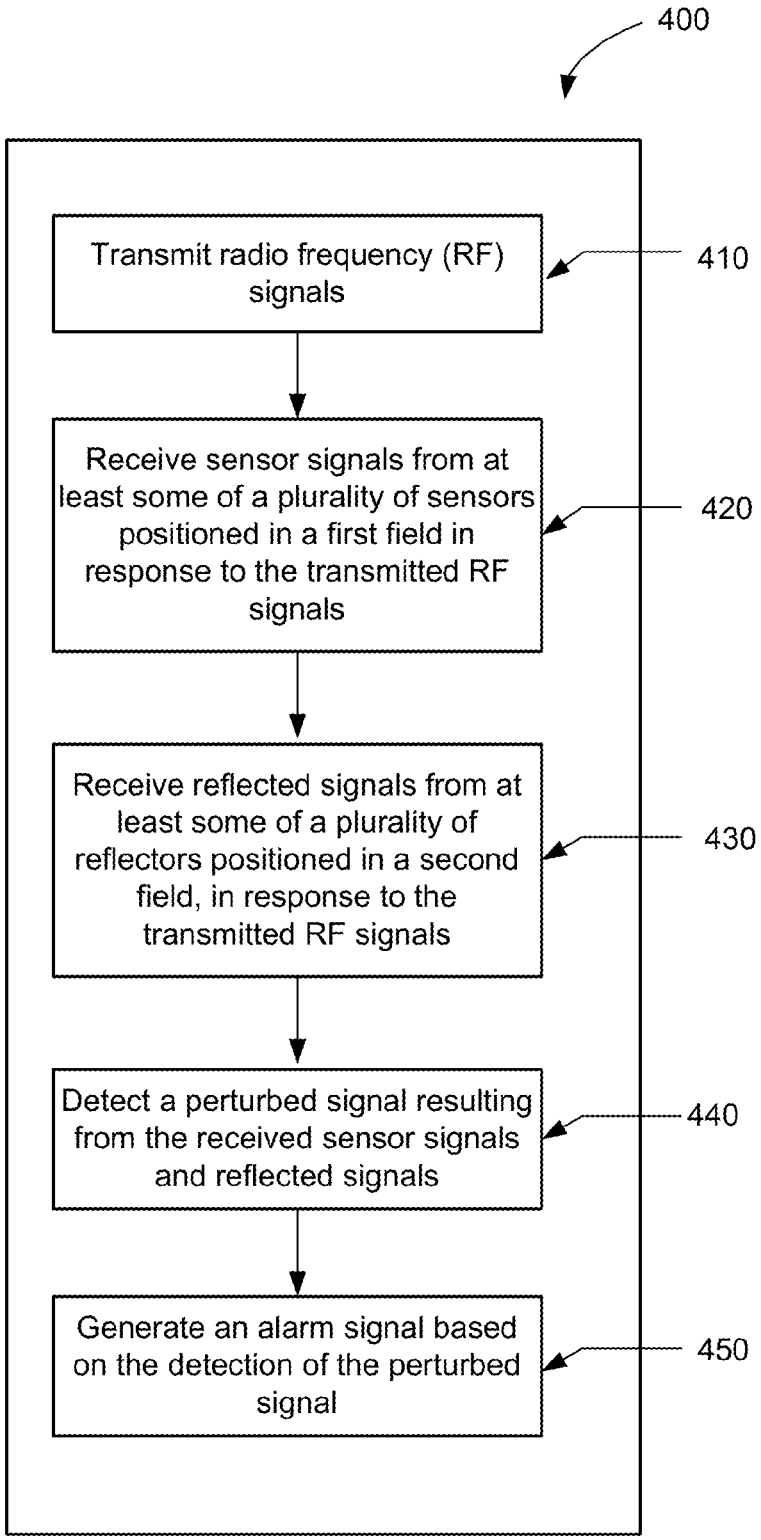
FIG. 4 is a diagram illustrating an example method of beyond perimeter detection and early warning, according to certain embodiments.

FIG. 4 is a diagram illustrating an example method 400 for beyond perimeter detection and early warning, according to certain embodiments. Method 400 may start at operation 410, where the transmitter 310 may transmit radio frequency (RF) signals. At operation 420, the first receiver 320 may receive sensor signals from some/all of the sensors positioned in a first field (e.g. the sensor field), in response to the transmitted RF signals. At operation 430, the second receiver 330 may receive reflected signals from some/all of the reflectors positioned in a second field (e.g., the reflector field) outside of a first perimeter defined by the first field, in response to the transmitted RF signals. The monitor module 340, at operation 440, may detect a perturbed signal resulting from the received sensor signals and reflected signals. The detection of the perturbed signal may be performed by making a comparison with a reference signal. The alarm module 350 may generate an alarm signal based on the detection of the perturbed signal (operation 450). The alarm signal may be an early warning alarm signal indicating that an intruder has crossed a second perimeter defined by the second field.

Figure 5:
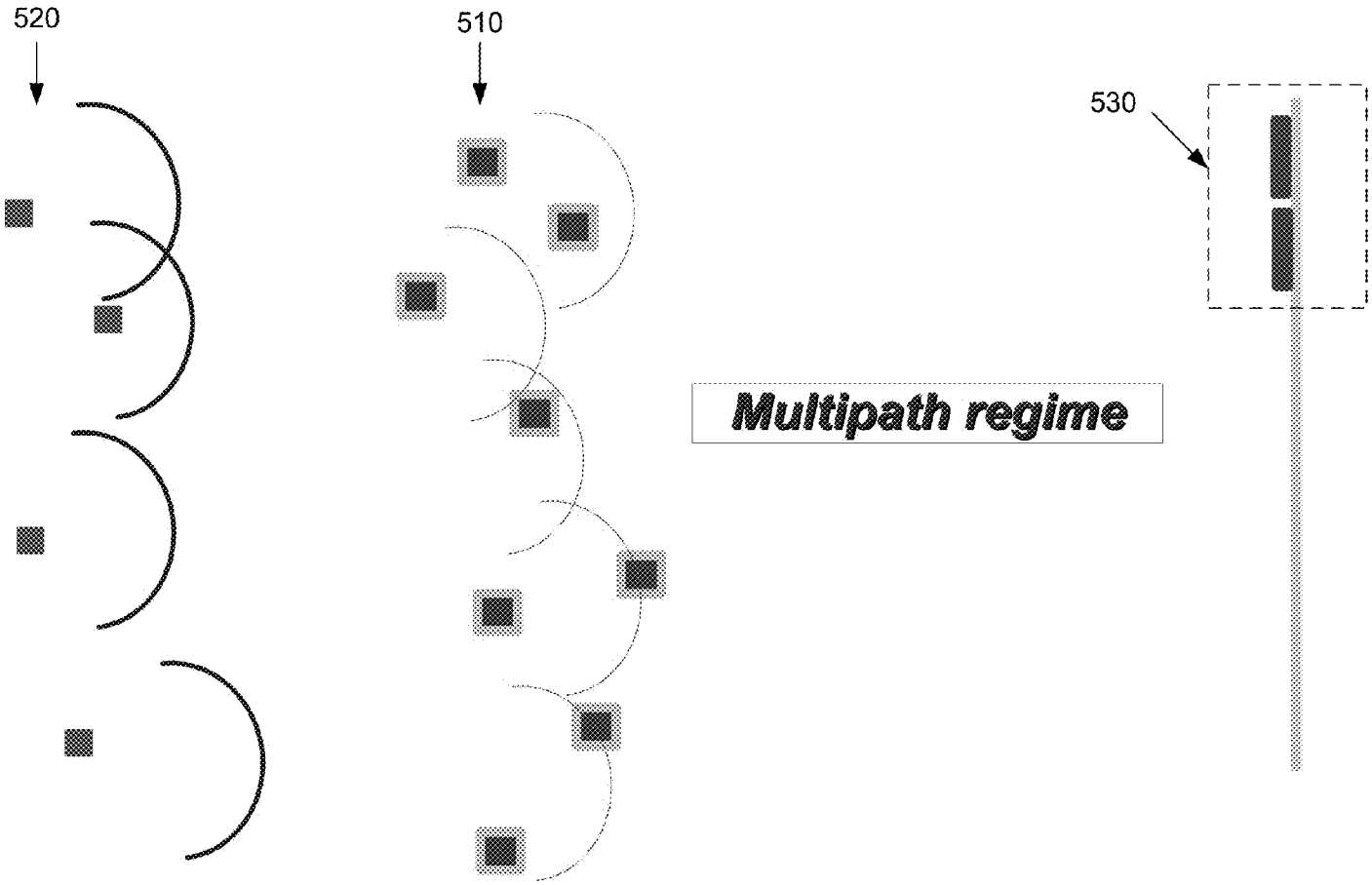
FIG. 5 is a diagram illustrating an exemplary multipath regime between sensors and reflectors positioned, respectively, in a sensor field and a reflector field and a transceiver, according to certain embodiments.

FIG. 5 is a diagram illustrating an exemplary multipath regime between sensors and reflectors positioned, respectively, in a sensor field 510 and a reflector field 520 and a transceiver 530, according to certain embodiments. The transceiver 530, receives individual signals from each of the sensors and reflectors in the sensor field 510 and reflector field 520, however, the transceiver 530 is calibrated to generate a reference signal which is the sum of the sensors signal and the reflected signals in a stable environment (e.g., without and intruder). Any changes in the environment caused by appearing an intruder in the environment may cause changes in at least the power profile of the received jumble signal from some/all of the sensors and reflectors in a multipath regime.

The multipath regime is characterized by the many paths to the transceiver from some/all of the sensor and reflectors in the sensor field 510 and the reflector field 520. In an aspect, the transceiver 530 or an antenna (e.g., antenna 305 of FIG. 3) coupled to the transceiver may be installed on a pole at an elevation, which may depend on the environment and the transmission pattern of the antenna. For example, when the environment is hilly, to make sure that the entire sensors and reflectors are within the view of the antenna, a higher elevation may be chosen.

Figure 6:
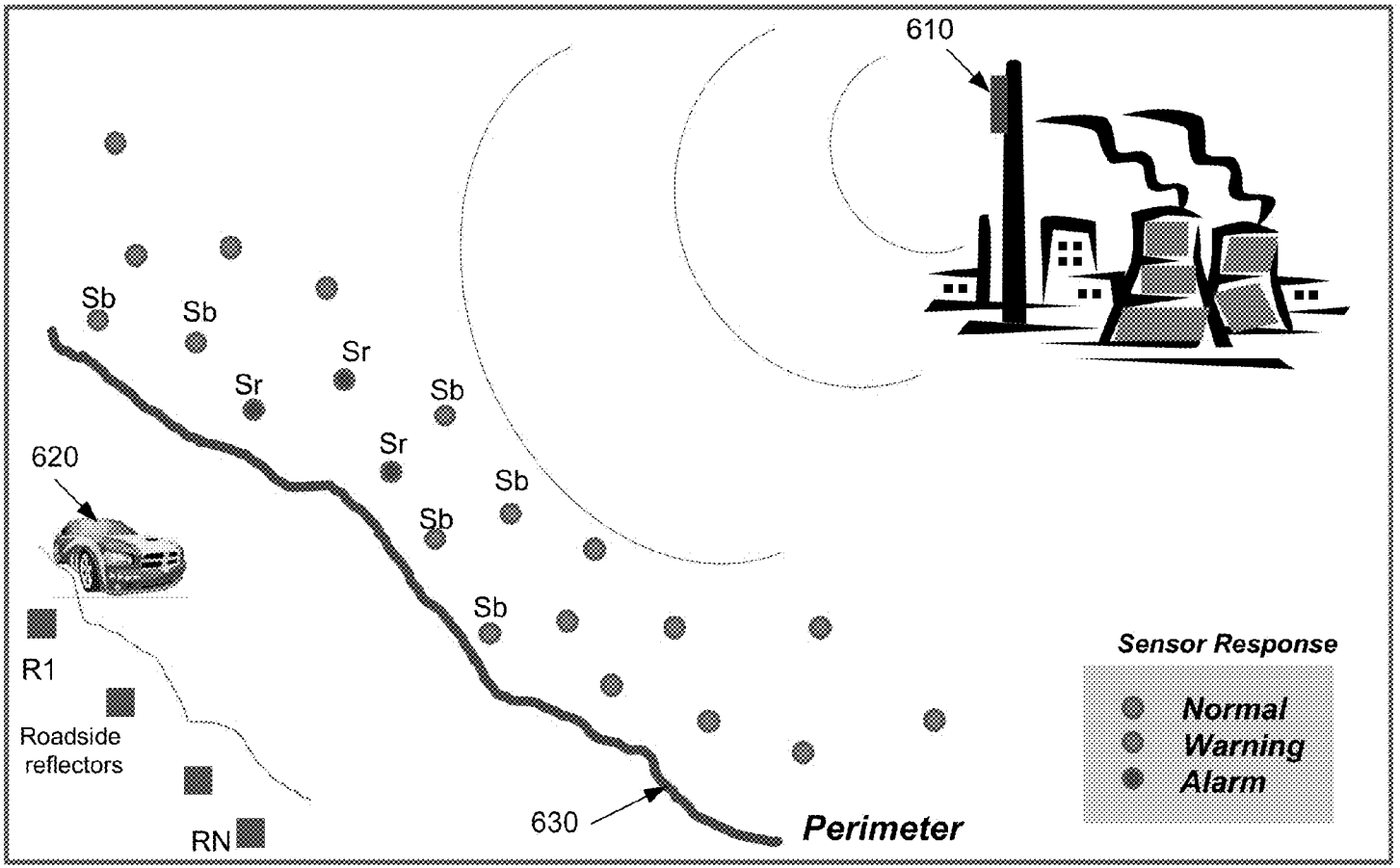
FIG. 6 is a diagram illustrating an example scenario where a car passes through a road between roadside reflectors and sensors in a sensor field, according to certain embodiments.

FIG. 6 is a diagram illustrating an example scenario where a car passes through a road between roadside reflectors and sensors in a sensor field, according to certain embodiments. The existence of the reflector (e.g., R1-RN) field on the roadside beyond the perimeter 630 of the sensor field may extend secured region beyond the boundaries of the sensor field. For example for scenarios where a large area needs to be secured (e.g., manufacturing facilities, airports, power plans, refineries, chemical plants, etc.), installing physical fences at large distances may turn out to be very costly. However, installing a number of reflectors or using some existing structures as reflectors, as part of a security and early warning system (e.g. including the transceiver 610 and sensors within the perimeter 630), may result in a significant saving in cost and maintenance. For example, in the scenario shown in FIG. 6, a number of reflectors installed on the other side of a road passing along the perimeter 630 of the sensor field allows detection of a passing car 620 on the road, therefore, extending the security zone even beyond a roadway on the side of the perimeter 630. Depending on the distance of the car 620 at any moment from a sensor the alarm signal levels associated with the sensor may change from green to blue (e.g., for sensors shows as Sb) and red (e.g., for sensors shown as Sr).

As mentioned earlier, the received signals may form a jumble of repeatable multipath signals. However, in a stable environment, the jumble of repeatable multipath signals may comprise certain distinctive characteristics. In other words, the sum of the signal from the sensors and the reflectors (e.g., mirrors) may remain constant in a stable environment. Any change to the environment will cause a change to the received power at the antenna. Thus, in one embodiment, the system or the monitor module may determine the power characteristics or map of the jumble of multi path signals for a given area or environment. This may be referred to as the control map or control power map. The control power map may then be used as a metric for comparing a real-time jumble of response signals. Based on the comparison, the system may determine whether the secured area have been breached.

In practice, the signal reflected off the mirrors may be perturbed first as an intruder approaches and therefore adds significant warning time for the security operator. For example, if the sensor read distance is 100 m, the mirror reflection distance could approach 500 m, thereby extending the detection range considerably. This may be particularly important around facilities such as nuclear power plants that are often surrounded by protected forest, open fields, or wetlands. Protecting such large areas using traditional security fence solutions may become impractical due to the cost issues associated with installation, maintenance, and operation of such systems, not to mention that most solutions require power in the field.

The description of the subject technology is provided to enable any person skilled in the art to practice the various embodiments described herein. While the subject technology has been particularly described with reference to the various figures and embodiments, it should be understood that these are for illustration purposes only and should not be taken as limiting the scope of the subject technology.

In some aspects, the subject technology is related to securing a perimeter. In some aspects, the subject technology may be used in various markets, including for example and without limitation, security markets.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various embodiments described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed embodiments, one having ordinary skill in the art will readily appreciate that these embodiments are only illustrative of the invention. It should be understood that various modifications can be made without departing from the spirit of the invention. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range is specifically disclosed. Also, the terms in the claims have their plain, ordinary meaning unless otherwise explicitly and clearly defined by the patentee. If there is any conflict in the usages of a word or term in this specification and one or more patent or other documents that may be incorporated herein by reference, the definitions that are consistent with this specification should be adopted.

What is claimed is:

1. A system for beyond perimeter detection and early warning, comprising:

a plurality of sensors positioned in a first field, each sensor of the plurality of sensors identified by a unique identifier;

a plurality of reflectors positioned in a second field; and one or more transceivers, each transceiver comprising:

a transmitter configured to transmit radio frequency (RF) signals, a first receiver configured to receive sensor signals from at least some of a set of the plurality of sensors in response to the transmitted RF signals, a second receiver configured to receive reflected signals from at least some of a set of the plurality of reflectors in response to the transmitted RF signals, a monitor module configured to detect a perturbed signal resulting from the received sensor signals and reflected signals, an alarm module configured to generate an alarm signal based on the detection of the perturbed signal, wherein:

a) the second field is outside a first perimeter defined by the first field, b) the alarm signal is an early warning alarm signal indicating that an intruder has crossed a second perimeter defined by the second field, c) the detection of the perturbed signal is performed by making a comparison with a reference signal.

2. The system of claim 1, wherein the monitor module is configured to generate the reference signal based on measured strength of the received sensor signals and the received reflected signals in an unperturbed condition, wherein the unperturbed condition is defined with respect to an intrusion of an intended intruder, and wherein the measured strength of a signal includes a measured power of the signal.

3. The system of claim 1, wherein the transmitter is configured to transmit RF signals at a plurality of transmission frequencies, and wherein each sensor is configured to respond to a transmission frequency of the plurality of transmission frequencies.

4. The system of claim 1, wherein the unique identifier is associated with a position information of a respective sensor and is used by the first receiver to identify a signal received from the respective sensor.

5. The system of claim 1, wherein each transceiver is configured to serve a portion of the first and second fields defined by an angular window.

6. The system of claim 1, wherein each of the perturbed signal and the reference signal are a jumble of repeatable multipath signals and the monitor module is calibrated to generate a stable reference signal which is a characteristic of non-intruded first and second fields.

7. The system of claim 1, wherein an intruder within the first field interferes with the received sensor signals from at least one sensor, and wherein the monitor module is configured to provide an estimate of a location of an intruder within the first field by using repeatable multipath signals from the sensors.

8. The system of claim 1, wherein the monitor module is calibrated to respond only to intended intruders including at least one of a human being, an animal, a robot, or a motor vehicle.

9. The system of claim 1, wherein the reflectors comprise at least one of RF reflectors, buildings, metallic structures, metallic fences.

10. A method, for beyond perimeter detection and early warning, comprising:

transmitting, from a transceiver, radio frequency (RF) signals;

receiving, at the transceiver, sensor signals from at least some of a plurality of sensors in response to the transmitted RF signals;

receiving, at the transceiver, reflected signals from at least some of a plurality of reflectors in response to the transmitted RF signals;

detecting, by a monitor module, a perturbed signal resulting from the received sensor signals and reflected signals; and generating an alarm signal based on the detection of the perturbed signal, wherein:

a) the plurality of sensors are positioned in a first field and each sensor of the plurality of sensors is identified by a unique identifier b) the plurality of reflectors are positioned in a second field outside a first perimeter defined by the first field, c) the alarm signal is an early warning alarm signal indicating that an intruder has crossed a second perimeter defined by the second field, d) the detection of the perturbed signal is performed by making a comparison with a reference signal.

11. The method of claim 10, further comprising generating the reference signal based on measured strength of the received sensor signals and the received reflected signals in an unperturbed condition, wherein the unperturbed condition is defined with respect to an intrusion of an intended intruder, and wherein the measured strength of a signal includes a measured power of the signal.

12. The method of claim 10, wherein transmitting the RF signals comprises transmitting the RF signals at a plurality of transmission frequencies, and wherein receiving sensor signals comprises receiving a sensor signal from each sensor in response to a transmission frequency of the plurality of transmission frequencies.

13. The method of claim 10, wherein the unique identifier is associated with a position information of a respective sensor and wherein the method further comprises using the unique identifier to identify a signal received from the respective sensor.

14. The method of claim 10, wherein receiving at the transceiver comprises receiving signals from a portion of the first and second fields defined by an angular window.

15. The method of claim 10, wherein each of the perturbed signal and the reference signal are a jumble of repeatable multipath signals and the method further comprises calibrating the monitor module to generate a stable reference signal which is a characteristic of non-intruded first and second fields.

16. The method of claim 10, wherein an intruder within the first field interferes with the received sensor signals from at least one sensor, and wherein the method further comprises providing an estimate of a location of an intruder within the first field by using repeatable multipath signals from the sensors.

17. The method of claim 10, further comprising calibrating the monitor module to respond only to intended intruders including at least one of a human being, an animal, a robot, or a motor vehicle.

18. The method of claim 10, wherein receiving reflected signals from the at least some of the plurality of reflectors comprise receiving reflected signals from at least one of RF reflectors, buildings, metallic structures, metallic fences.

19. A system for beyond perimeter detection and early warning, comprising:

a transmitter configured to transmit radio frequency (RF) signals, a first receiver configured to receive sensor signals from at least some of a set of a plurality of sensors in response to the transmitted RF signals, a second receiver configured to receive reflected signals from at least some of a set of a plurality of reflectors in response to the transmitted RF signals, a monitor module configured to detect a perturbed signal resulting from the received sensor signals and reflected signals, an alarm module configured to generate an alarm signal based on the detection of the perturbed signal, wherein:

a) the plurality of sensors are positioned in a first field and each sensor of the plurality of sensors is identified by a unique identifier b) the plurality of reflectors are positioned in a second field outside a first perimeter defined by the first field, c) the alarm signal is an early warning alarm signal indicating that an intruder has crossed a second perimeter defined by the second field, d) the detection of the perturbed signal is performed by making a comparison with a reference signal.

20. The system of claim 19, wherein the monitor module is configured to generate the reference signal based on measured strength of the received sensor signals and the received reflected signals in an unperturbed condition, wherein the unperturbed condition is defined with respect to an intrusion of an intended intruder, and wherein the measured strength of a signal includes a measured power of the signal.

* * * * *